US006145456A

United States Patent [19]

Codos

[11] Patent Number: 6,145,456

[45] Date of Patent: Nov. 14, 2000

[54] QUILTING MACHINE WITH ADJUSTABLE PRESSER PLATE AND METHOD OF OPERATING THE QUILTING MACHINE

[75] Inventor: Richard N. Codos, Warren, N.J.

[73] Assignee: L&P Property Management Company, South Gate, Calif.

[21] Appl. No.: 09/306,744

[22] Filed: May 7, 1999

[51] Int. Cl.[7] ..... D05B 11/00; D05B 29/02

[52] U.S. Cl. ..... 112/117; 112/235

[58] Field of Search ..... 112/117, 118, 112/119, 235, 2.1, 292

[56] References Cited

U.S. PATENT DOCUMENTS

| | | | |
|---|---|---|---|
| 1,948,876 | 2/1934 | Boettcher . | |
| 2,540,987 | 2/1951 | McCann . | |
| 2,560,334 | 7/1951 | Enos . | |
| 2,576,357 | 11/1951 | Preston . | |
| 3,147,720 | 9/1964 | Kuhn . | |
| 3,385,246 | 5/1968 | Schlegel . | |
| 3,410,238 | 11/1968 | Rolauffs . | |
| 3,473,497 | 10/1969 | Cash . | |
| 3,633,525 | 1/1972 | Landoni . | |
| 4,006,696 | 2/1977 | Robertson . | |
| 4,006,697 | 2/1977 | Robertson . | |
| 4,060,045 | 11/1977 | Vahle et al. . | |
| 4,089,281 | 5/1978 | Landoni . | |
| 4,409,914 | 10/1983 | Sansone . | |
| 4,454,830 | 6/1984 | Bennett . | |
| 4,466,369 | 8/1984 | Dreier . | |
| 4,508,043 | 4/1985 | Vollmar . | |
| 4,550,671 | 11/1985 | Dusch . | |
| 4,852,506 | 8/1989 | Salganik . | |
| 5,001,997 | 3/1991 | Wang . | |
| 5,042,406 | 8/1991 | Jimenez et al. . | |
| 5,154,130 | 10/1992 | Gribetz et al. | 112/292 |
| 5,355,816 | 10/1994 | Echevarria | 112/2.1 |
| 5,461,997 | 10/1995 | Landen . | |
| 5,509,365 | 4/1996 | Cash . | |
| 5,590,614 | 1/1997 | Murata et al. . | |
| 5,617,802 | 4/1997 | Cash . | |
| 5,634,417 | 6/1997 | Katou . | |
| 5,694,872 | 12/1997 | Zeller . | |
| 5,960,730 | 10/1999 | Picker . | |
| 5,967,068 | 10/1999 | Landoni . | |

*Primary Examiner*—Peter Nerbun
*Attorney, Agent, or Firm*—Wood, Herron & Evans, L.L.P.

[57] ABSTRACT

An apparatus for stitching fabric to produce a quilted fabric having a needle plate for supporting the fabric, a presser plate located at a first position above the needle plate and a needle located above the presser plate. A needle rocker shaft is mechanically connected to the needle and imparts a reciprocating motion to the needle in response to the angular displacements of the needle rocker shaft. Further, a presser plate rocker shaft is mechanically connected to the needle rocker shaft and imparts a reciprocating motion to the presser plate in response to the angular displacements of the presser plate rocker shaft. The presser plate rocker has an output shaft movable to a different relative angular positions with respect to an input shaft in order to locate the presser plate at a second position with respect to the needle plate. The first and second positions of the presser plate provide respective first and second gaps with respect to the needle plate and permit fabrics of different thicknesses to be quilted.

3 Claims, 6 Drawing Sheets

QUILTING MACHINE WITH ADJUSTABLE PRESSER PLATE AND METHOD OF OPERATING THE QUILTING MACHINE

FIELD OF THE INVENTION

This invention relates generally to the field of quilting machines and, more particularly, to an improved quilting machine for stitching quilts of different thicknesses.

BACKGROUND OF THE INVENTION

In the manufacture of quilted fabrics in which, for example, a cover, a liner and one or more layers of filling material are joined to form an article such as a quilted furniture cover or a mattress cover, automated quilting machinery is commonly employed to stitch the layers of material together, with stitching applied in repeated patterns, or arrays of repeated patterns. High speed and economic production of such quilted fabrics generally requires equipment utilizing arrays of needles, ganged together and driven through a common stitch forming mechanism, to apply a plurality of patterns simultaneously in a predetermined array.

In between each stitch of the needle, the layers of fabric are moved in unison with respect to the needles in order to place the next stitch at the desired point in the quilting pattern. Further, with each stitch cycle of the needles, a presser plate is moved toward a needle plate to compact the layers of material for the stitching process. As the needles move out of the material, the pressure plate is simultaneously lifted or moved away from the needle plate, thereby permitting the material to be moved for the next stitch. Normally, the needles are mechanically coupled to and driven by a needle bar rocker shaft that, in turn, is mechanically connected to and driven by a continuously rotating drive shaft. The presser plate is also mechanically connected to and driven by the needle bar rocker shaft. The motion of the presser plate is thus mechanically and constantly fixed with respect to the motion of the needle.

With every stitch cycle, the presser plate starts at the same uppermost position with respect to the needle plate, moves downward to the same lowermost position with respect to the needle plate and then retracts upward to the starting uppermost position. Thus, with each stitch, the pressure plate moves the same distance downward to the same material compaction position and then retracts the same distance to its uppermost starting position. Since the operation of the pressure plate is mechanically fixed throughout the quilting process, the gap between the pressure plate and the needle plate at any point in the stitching cycle is always the same. Therefore, a quilting machine is practically limited to stitching layers of material that have the same thickness. The relative motion of the pressure plate is controlled by cams on a rocker shaft. Therefore, it is possible to change those cams in order to provide a different gap between the pressure plate and the needle plate during the stitching cycle. Even though reconfiguring the quilting machine is possible by changing various cams, the task requires many hours of complex and difficult labor and, therefore is rarely if ever done.

Therefore, as a practical matter, if one desires to stitch a thicker quilt, a different quilting machine is generally used which is configured to have a generally larger gap between the presser plate and the needle plate throughout the stitching cycle. With a thicker quilt, the presser plate must have a higher starting position that allows the thicker quilt to be inserted thereunder and a higher, full compaction position that properly compresses the thicker quilt during the stitching process. The requirement that different quilting machines must be used to stitch quilts having different thicknesses presents significant disadvantages. For example, for those who can afford only one quilting machine, their market is limited to those applications for quilts of the thickness that can be produced on that one machine. In other situations, the commercial demand or quantity of a quilt of a particular thickness may be relatively small; and therefore, the purchase of an automated quilting machine cannot be economically justified. Thus, those markets must be served by quilts that have a higher labor content and thus, are more expensive.

Consequently there in a need for an improved quilting machine that is more flexible in its operation and reconfiguration so that with an easy adjustment quilts of different thicknesses may be stitched.

SUMMARY OF THE INVENTION

The present invention provides a quilting machine and method that is substantially more flexible in its operation. The quilting machine of the present invention permits the quilting machine to be easily reconfigured, that is, different gaps to be easily set between a presser plate and a needle plate, so that fabric layers of different thicknesses can be stitched on the same machine. Thus, the invention permits one machine to serve a great many different markets for quilted fabrics. Further, small quantities of quilted fabrics of different thicknesses can be economically supplied with a single machine. Thus, the quilting machine of the present invention provides its user with opportunities to supply different quilted products in a way that was not possible in the past with a single quilting machine.

In accordance with the principles of the present invention and in accordance with the described embodiments, the present invention provides an apparatus for stitching fabric to produce a quilted fabric having a needle plate for supporting the fabric, a presser plate located at a first position above the needle plate and a needle. A needle rocker shaft is mechanically connected to the needle and imparts a reciprocating motion to the needle in response to the angular displacements of the needle rocker shaft. Further, a presser plate rocker shaft is mechanically connected to the needle rocker shaft and imparts a reciprocating motion to the presser plate in response to the angular displacements of the presser plate rocker shaft. The presser plate rocker shaft has input and output shafts that are easily movable to different relative angular positions to locate the presser plate at a second position with respect to the needle plate. The first and second positions of the presser plate provide respective first and second gaps with respect to the needle plate and permit fabrics of different thicknesses to be quilted.

In one aspect of the invention, the presser plate rocker shaft includes a coupling for moving the input and output shafts of the presser plate rocker shaft to the different angular positions with respect to each other. Thus, the gap between the presser plate and the needle plate can be changed without changing the position of the needle.

In another embodiment of the invention, a method of operating a quilting machine is described which includes setting the presser plate to a first position with respect to the needle plate, loading a first fabric having a first thickness, stitching the first fabric, stopping the machine, setting the presser plate to a second position with respect to the needle plate without changing cams on the machine, loading a second fabric having a second thickness, and stitching the second fabric.

These and other objects and advantages of the present invention will become more readily apparent during the following detailed description together with the drawings herein.

DETAILED DESCRIPTION OF THE INVENTION

Figure 1:
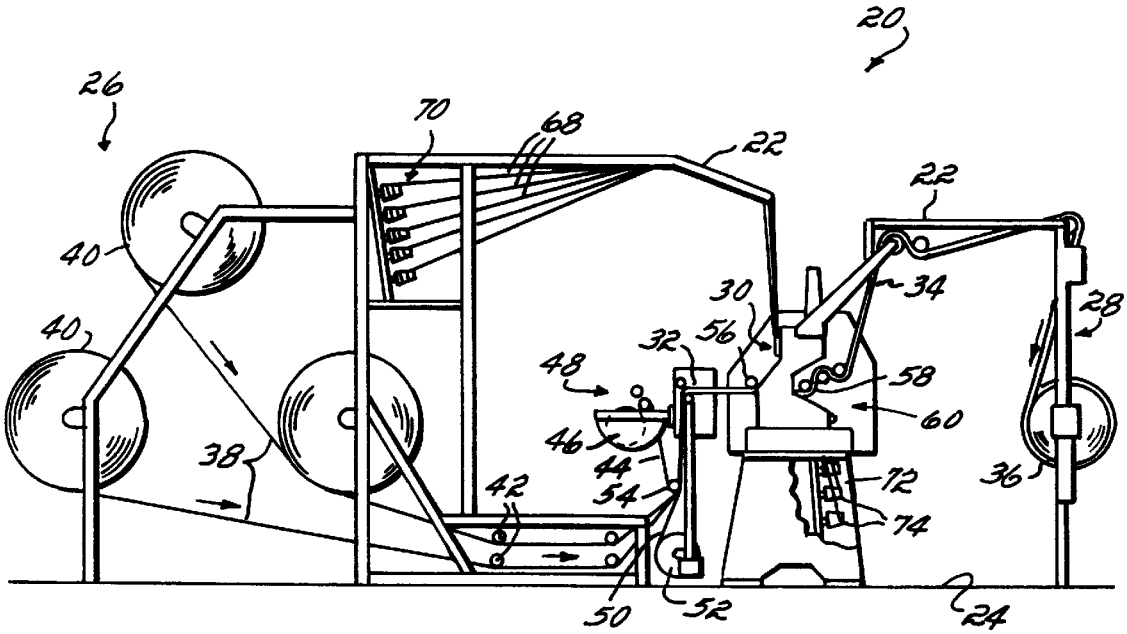
FIG. 1 is an elevation view of a quilting machine embodying the principles of the present invention.

Referring to FIG. 1, a double lock chain stitch quilting machine 20 according to one embodiment of the present invention is illustrated. The machine 20 includes a frame 22 assembled in one or more components on a plant floor 24. Assembled to the frame 22 is a fabric material supply station 26 at the upstream end of the frame 22, a quilt take-up station 28 at the downstream end of the frame 22, and a quilting station 30 between the supply station 26 and the take-up station 28.

At the quilting station 30, a stitch pattern is applied to a multiple layered fabric 32 to form a quilt 34, which then passes to the take-up station 28 where it is wound upon a take-up roll 36, which is rotatably supported on a transverse axle to the frame 22 at the take-up station 28. The fabric 32 is formed of one or more layers of filler material 38 from supply rolls 40 mounted on horizontal transverse axles to the frame 22 at the supply station 26. The filler material 38 is fed downstream from the supply station 26 around guide rollers 42 and between two layers of cover material, including an outer cover 44 from a supply roll 46 lying in a trough mounted to the frame 22 above the flights of filler material 38 at the entry end 48 of the quilting station 20, and a liner or backing 50 from a supply roll 52, rotatably mounted on a transverse axle to the frame 22 below the filler material 38 at the entry end 48 of the quilting station 30.

The layers of material 38, 44 and 50 are brought together at a roller station 54 at the entry end 48 of the quilting station 30, to form the fabric 32. The roller station 54 includes two pair of transversely extending, transversely shiftable, reversible feed rollers 56, 58. Rollers 56 are adjacent the entry end 48 of the quilting station 30 and receive the fabric 32 before it enters the quilting station 30. The entry feed rollers 56 are driven in synchronism with cooperating exit feed rollers 58 at the exit end 60 of the quilting station 30 rotating or transversely shifting together, to advance, reverse and transversely shift the fabric 32 as it moves through the quilting station 30.

At the quilting station 30, the fabric 32 is sewn, with a stitch forming mechanism into arrays 62 of a quilted pattern 64 (FIG. 2) from a plurality of needle threads 68, from a plurality of needle thread spools 70 mounted on the frame 22 near the supply station 26, and a plurality of looper threads 72, from a plurality of looper thread spools 74 mounted on the frame 22 beneath the quilting station 30.

In a known manner, the needle threads 70 pass through a bank of thread tension adjusters at the front side of the frame 22 at the quilting station, prior to passing to the quilting station 30. These adjusters are mechanically settable to provide proper thread tension. They are also controlled by pneumatic solenoid controlled actuators to switch between a tension state, at which the set tension is applied to the needle threads 70, and a release state, at which no tension or minimum tension is applied to the threads 70. Alternatively, separate thread clamps may be provided at a position along the thread close to the needles; however, their exact location is dependent on the elasticity of the thread, and is selected to avoid thread snap-back and unthreading of the needles. Other details of the quilting machine 20 illustrated in FIG. 1 are set forth in the commonly owned U.S. Pat. No. 5,154,130 which is hereby in its entirety incorporated by reference herein. Further, such machines are commercially available from Gribetz International of Sunrise, Fla.

Figure 2:
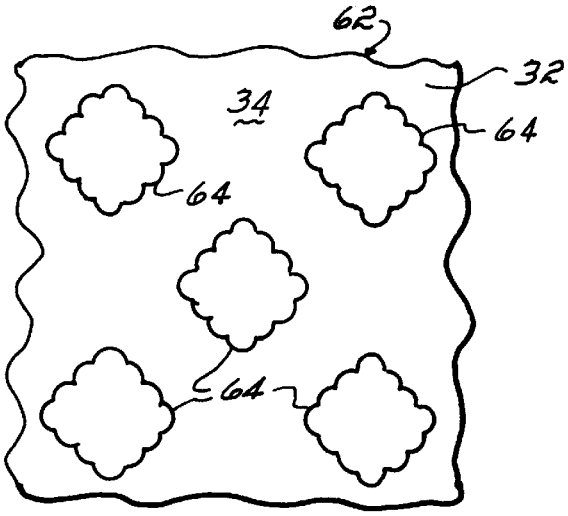
FIG. 2 is a plan view of the front side of a fabric quilted with an array of discrete 360° patterns.
Figure 3:
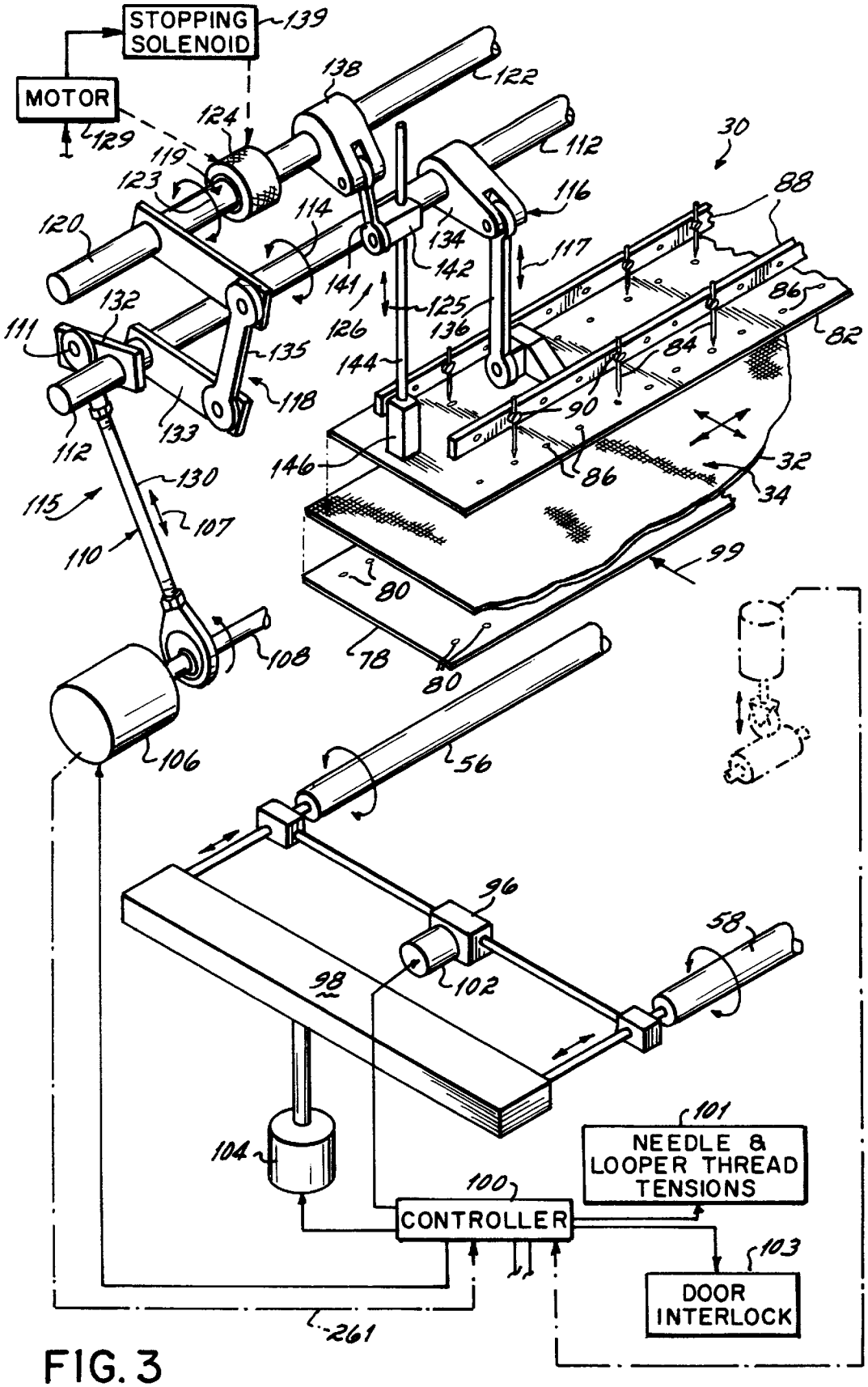
FIG. 3 is a diagrammatic disassembled perspective view illustrating the quilting machine components and relationship of the actuators and drives of the quilting machine of FIG. 1.
Figure 4:
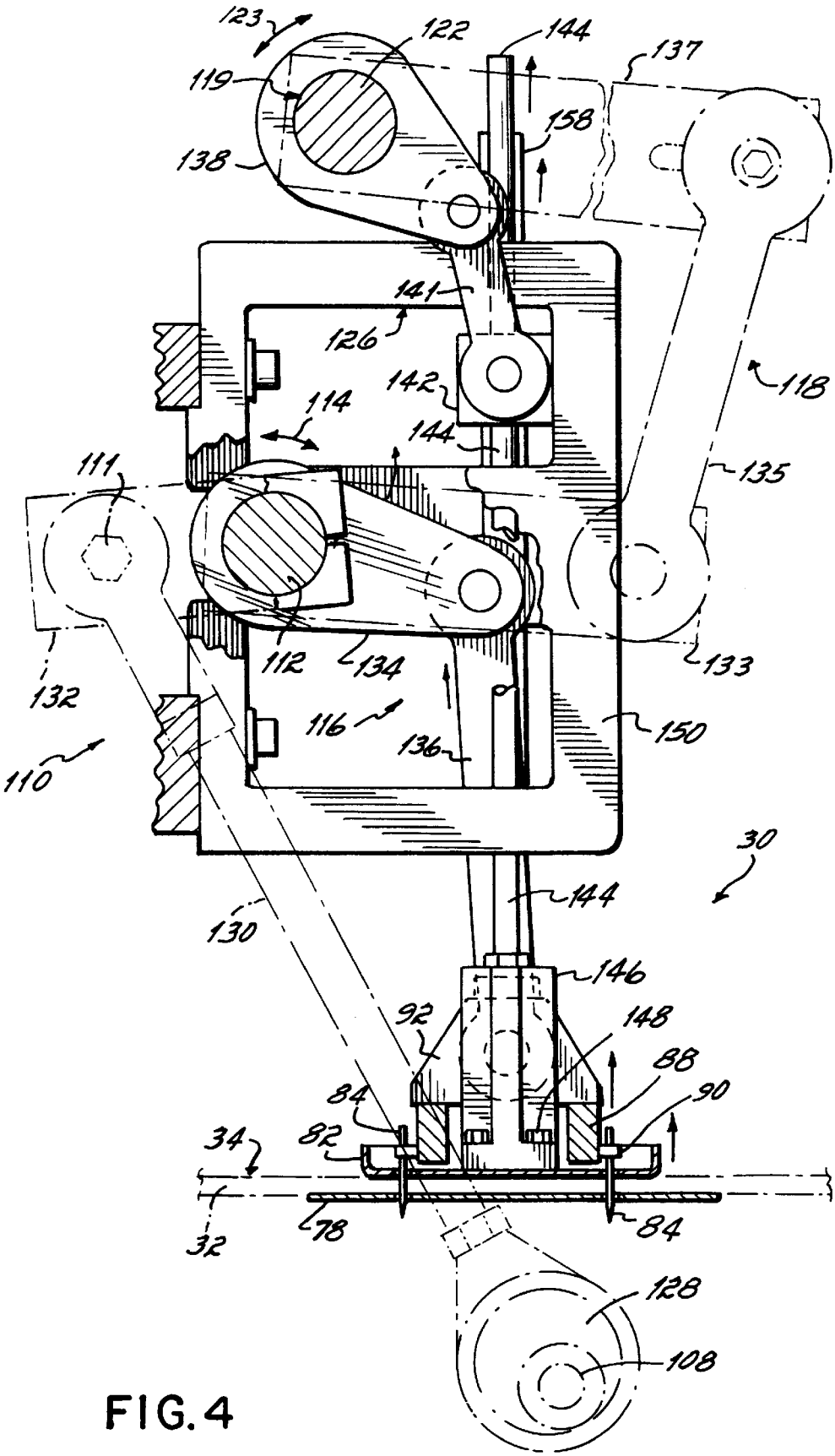
FIG. 4 is a cross-sectional end view of the quilting station of FIG. 1 illustrating the various interconnecting drives in accordance with the principles of the present invention.

As illustrated in FIGS. 3 and 4, a needle plate 78 supports the fabric 32 as patterns, such as pattern 64 (FIG. 2), are stitched on it to form the quilt 34. The needle plate 78 has a matrix of needle receiving holes 80 spaced approximately one inch apart in parallel rows, spaced about six inches apart. A presser foot or plate 82, which is located above the needle plate 78, moves down to press the fabric 32 against the needle plate 78 to hold the fabric as needles 84 are extended through it, and the presser plate 82 moves up to allow the fabric 32 to be moved. The presser plate 82 also has a matrix of holes 86 which correspond to the matrix of needle holes 80 in the needle plate 78.

Positioned above the presser plate 82 is a set of parallel transversely oriented and longitudinally spaced needle support bars 88, each having a matrix of needle holders 90 thereon corresponding to, and spaced directly above, each of the holes 86, 80 in respective presser and needle plates 82, 78. Each of the holders 90 includes a vertical groove and a clamping screw positioned in a threaded hole beside the groove to clamp the needle securely in position. The needles 84 are mounted in an array on the needle bars 88 to define the relative spacings of patterns, such as pattern 64 in pattern array 62 (FIG. 2). The needle bars 88 are ganged through cross members 92, mounted to reciprocate vertically on the frame 22 at quilting station 30, to move up and down on the frame 22, as shown by the arrow 94, so that each of the needles 84 passes through corresponding holes 86, 80 in the respective presser and needle plates 82, 78.

The array 62 of discrete patterns, such as the pattern 64 of FIG. 2, is achieved by programmed motion of the fabric 32 transversely and longitudinally by motion of the feed rollers 56 and 58 moving in synchronism with the operation of the presser plate 82 and needle bars 88 to form stitches, preferably of equal length, in the pattern shape. The 3600 patterns 64 of the array 62 are accomplished by forward and reverse rotation of the feed rollers 56 and 58 as well as transverse reciprocating motion of the rollers 56 and 58. The discrete character of the patterns 64 of FIG. 2 involves the formation of several tack stitches upon the completion of a pattern 64, a cutting of at least the top or needle threads 68, and a repositioning of the fabric 32 under the needles 84 for the beginning of the next pattern. The feed rollers 56 and 58 are driven in synchronism by the a feed roller movement mechanism that includes a roller reversible rotary drive 96, shown schematically in FIG. 3. The reversibility of the drive 96, and the ability to pull the fabric 32 from the front by rollers 56 as well as from the back by rollers 58, provides an ability to form 360° patterns such as pattern 64. During the stitching process, the fabric 32 feeds generally in the direction of the arrow 99.

The rollers 56 and 58 are also shiftable transversely, in synchronism with each other, by transverse roller drive 98. These roller drives 96 and 98 are electronically linked to the operation of the presser plate 82 and needle bars 88 by a controller 109. The rotary feed drive 96 is driven by feed motor 102 while the transverse drive 98 is driven by shift motor 104. The ratio and relative direction of the drives 96 and 98 and operation of the presser plate 82 and needle bars 88 is controlled in response to a computer, containing a pattern program, within the controller 100. The controller 100 permits the drives 96 and 98 and the motors 102 and 104 to be driven in synchronism with, or disengaged from, the presser plate 82 and needle bars 88, which are driven by a separate drive motor 106. Each of the motors 102, 104, 106 can be locked in position while the others are activated, under control of the controller 100. The controller 100 further controls needle and looper thread tensioners 101 and responds to the states of door interlocks 103 in a known manner.

An output shaft of the motor 106 is connected to a main drive shaft 108 that extends transversely to the fabric feed direction along the length of the quilting station 30. The main drive shaft 108 rotates continuously but by means of an eccentric coupling, imparts a linear oscillating motion to mechanical linkage 110 that drives a needle bar rocker shaft 112 through reciprocating angular oscillations as indicated by the arrow 114. The angular displacement or amplitude of the angular oscillation is determined by the eccentric drive coupled to the main drive shaft 108 and the mechanical linkage 110 interconnecting the needle rocker shaft 112 with the main drive shaft 108. The needle rocker shaft 112 extends transversely to the fabric feed direction along the length of the quilting station 30. At selected locations, mechanical linkage 116 interconnects the needle bars 88 with the needle rocker shaft 112 and functions to convert the reciprocating angular oscillations of the needle bar rocker shaft 112 into a vertical reciprocating motion of the needle bars 88 as indicated by the arrow 117. The linear displacement or amplitude of the reciprocating motion of the needle bars 88 is a function of the magnitude of the oscillation of the needle bar rocker shaft 112 and the mechanical linkage 116.

Mechanical linkage 118 is used to connect a presser plate input rocker shaft 119 with the needle bar rocker shaft 112. The presser plate rocker shaft 119 is comprised of an assembly of a presser plate input rocker shaft 120, a presser plate output rocker shaft 122 and a static phase adjusting coupling 124 connected between the shafts 120, 122. The presser plate rocker shaft 119 oscillates through an angular displacement represented by the arrow 123, and that displacement is temporally identical with the angular oscillations of the needle bar rocker shaft 112. The magnitude or angular displacement with each oscillation of the presser plate rocker shaft 119 is a function of the amplitude of the oscillation of the needle bar rocker shaft 112 and the mechanical linkage 118 interconnecting the shafts 112, 120. Mechanical linkage 126 interconnects the output presser plate rocker shaft 122 with the presser plate 82 and imparts a reciprocating vertical motion to the presser plate 82, as indicated by arrow 125, in response to the angular oscillations of the output presser plate rocker shaft 122. The linear displacement or amplitude of each reciprocation of the presser plate 82 is a function of the angular displacement of the oscillation of the output presser plate rocker shaft 122 and the mechanical linkage 126.

Thus, the operation of the drive motor 106 causes the presser plate 82 to move through a vertically linear reciprocating motion that is synchronized with a vertically linear reciprocating motion of the needle bars 88, thereby permitting the fabric 32 to be moved by the feed rollers 56, 68 and the drive 96 to desired different locations between each stitching cycle.

The static phase adjusting coupling 124 is a 360° positioner commercially available from Candy Controls of Niles, Ill. The phase adjusting coupling 124 is used to change the relative angular position of the output presser plate rocker bar 122 with respect to the input presser plate rocker bar 120, thereby changing the amplitude of the reciprocating linear motion of the presser plate 82 as well as the location of that reciprocating motion with respect to the needle plate 78. By changing the location of the reciprocating motion, the gap between the presser plate 82 and needle plate 78 is thereby adjustable to permit quilts of different thicknesses to be stitched by the quilting station 30.

Figure 5:
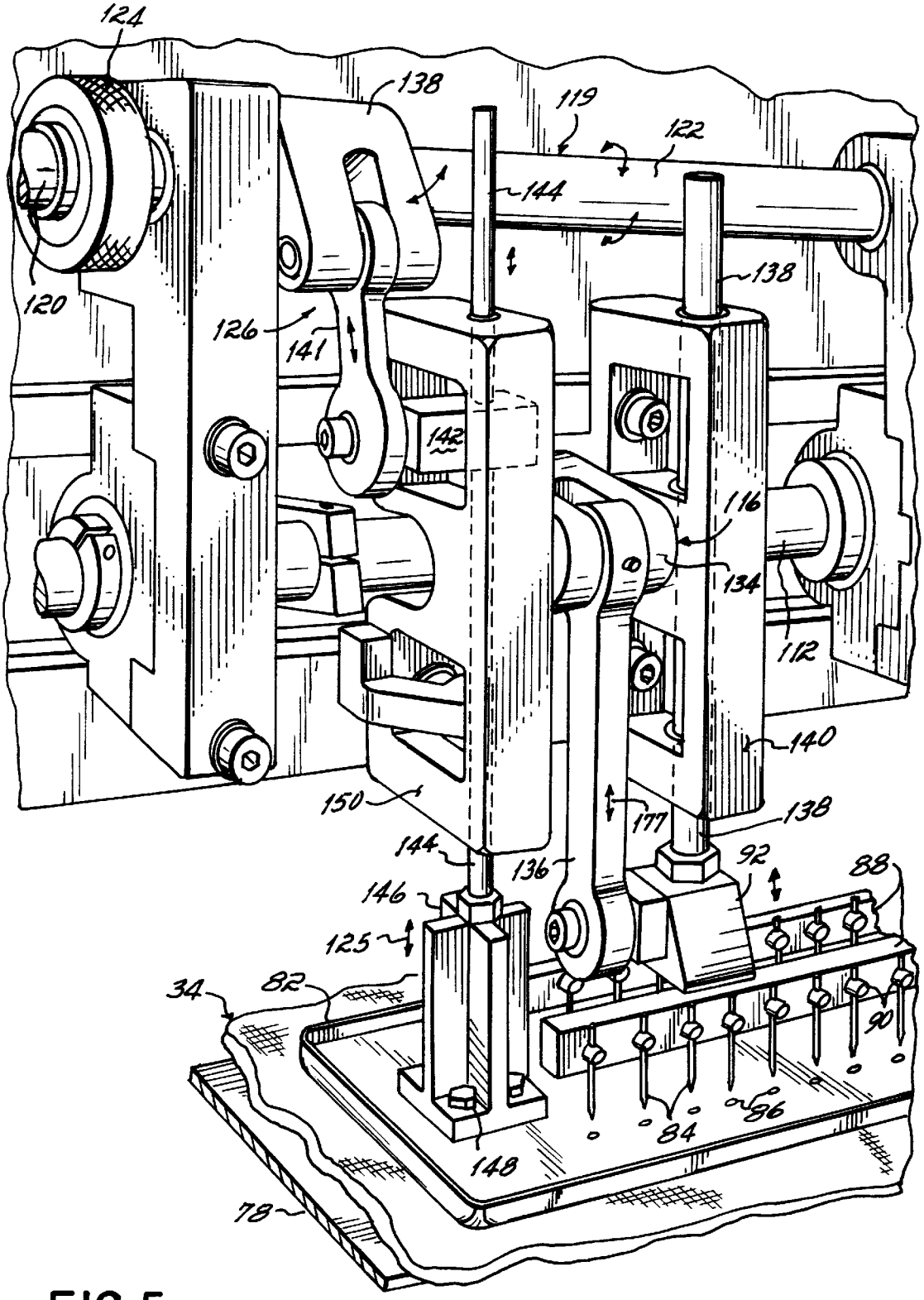
FIG. 5 is a perspective view of one set of the mechanical linkages used to operate the presser plate and needle bars.

FIGS. 3–5 illustrate further details of the drive mechanisms for the presser plate 82 and needle bars 88. It should be noted that in FIGS. 3–5, many structural details of the quilting station 30 are not illustrated to clarify the operation of the drive mechanism. Further, drive shaft 108 and rocker shafts 112, 122 extend transversely to the direction of feed of the fabric 32 across the full length of the quilting station 30 and are supported by bearings at both ends of the shafts. The linkage 110 connecting the drive shaft 108 to the needle bar rocker shaft 112 is normally located at one end of the shaft 108. As will be appreciated, one or more mechanical linkages 110 can be used to mechanically couple the shaft 108 to the needle bar rocker shaft 112. For example, identical mechanical linkages 110 can be located at opposite ends of the drive shaft 108. Further, the mechanical linkage 118 interconnecting the needle bar rocker shaft 112 with the pressure plate rocker shaft 122 may be located at any point on the drive shaft 108 but normally is located close to one end of the drive shaft 108 and inside of the mechanical linkage 110. Typically, a number of mechanical linkages 116 interconnecting the needle bar rocker shaft 112 to the needle bars 88 are equally spaced over the length of the quilting station 30. Normally, a mechanical linkage 126 interconnecting the presser plate rocker shaft 122 with the presser plate 82 is located over the length of the presser plate rocker shaft 119 adjacent to each of the mechanical linkages 116.

Referring to FIGS. 3 and 4, the main drive shaft 108 includes an eccentric cam 128. The mechanical linkage 110 is comprised of a connecting rod 130 journalled at one end around the main drive shaft 108 and eccentric 128. The connecting rod 130 is pivotally connected at its opposite end to the distal end of a needle bar rocker lever 132. The proximal end of the lever 132 is clamped or otherwise mechanically fixed onto the needle bar rocker shaft 112. Thus, rotation of the drive shaft 108 by motor 106 (FIG. 3) causes the connecting rod to reciprocate in a direction parallel to its longitudinal center line. The linear displacement or amplitude of each reciprocation is a function of the eccentricity of the eccentric cam 128.

The mechanical linkage 118 connecting the needle bar rocker shaft 112 with the input presser plate rocker shaft 120 is comprised of a first driving lever 133 and a connecting link 135 and a driven lever 137. The proximal end of the driving lever 133 is clamped or otherwise mechanically fixed to the needle bar rocker shaft 112. The distal end of the driving lever 133 is pivotally connected to one end of the connecting link 135 and the opposite end of the connecting link 135 is pivotally connected to the distal end of the driven lever 137. The proximal end of the driven lever 137 is clamped or otherwise mechanically fixed to the input presser plate rocker shaft 120.

Referring to FIGS. 3–5, the mechanical linkage 116 connecting the needle bar rocker shaft 112 to the needle bars 88 is comprised of a needle bar drive lever 134 and a needle bar connecting rod 136. The proximal end of the needle bar drive lever 134 is clamped or otherwise mechanically fixed to the needle bar rocker shaft 112, and the distal end of the needle bar drive lever 134 is pivotally connected to an upper end of the needle bar connecting rod 136. The lower end of the needle bar connecting rod is pivotally connected with respect to a cross member 92 that is clamped or otherwise rigidly connected to the needle bars 88. The cross member 92 has a guide rod 138 extending vertically upward through a frame member 140 to ensure that the needle bars 88 reciprocate in a vertical direction. Thus, angular oscillations of the needle bar rocker shaft 112 are converted by mechanical linkage 116 into vertical reciprocating motion of the needle bars 88.

The mechanical linkage 126 connecting the output presser plate rocker shaft 122 to the presser plate 82 is comprised of a presser plate lever 138, a presser plate drive link 141 and a presser plate guide rod 142. The proximal end of the presser plate lever 138 is clamped or otherwise mechanically secured to the presser plate rocker shaft 122. The distal end of the presser plate lever is pivotally connected to an upper end of the presser plate drive link 141. The presser plate guide rod 142 is mounted within bearings (not shown) that in turn are supported by a frame member 150. The lower end of the presser plate drive link 141 is pivotally connected to a presser plate block 142 that is clamped or otherwise mechanically secured to an upper end of a presser plate guide rod 144. The lower end of the presser plate guide rod terminates into a presser plate mounting block 146 that is secured to the presser plate 82 by fasteners 148 or other means. Thus, oscillations of the needle bar rocker shaft 112 are transmitted via the mechanical linkage 118 to the presser plate rocker shaft 122. Angular oscillations of the presser plate rocker shaft 122 are transferred via mechanical linkage 126 to vertical reciprocations of the presser plate 82.

In use, assume that the quilting machine 20 has been set up to establish a gap between the presser plate 82 and the needle plate 78 that is suitable to stitch layers of fabric 32 that are relatively thin. Referring to FIG. 6A, in this example, the presser plate 82 is located approximately 0.25 inches above the needle plate 78, and a first fabric 32 having a first thickness is loaded into the quilting station 30 and located between the presser plate 82 and the needle plate 78. As the needle bar rocker shaft 112 begins its oscillation in the generally clockwise direction, mechanical linkage 116 shown in FIGS. 3–5 causes the needle 84 to begin traveling vertically downward as previously described. Further, the presser plate rocker shaft 119, being mechanically linked to the needle bar rocker shaft 112 by mechanical linkage 118, also begins to rotate in the clockwise direction. Clockwise rotation of the presser plate rocker shaft moves the presser plate 82 vertically downward to compact the fabric 32. The presser plate 82 and needle 84 continue their downward motion until the needle bar rocker shaft 112 rotates through an angular displacement of approximately 40° to the position illustrated in FIG. 6B. The mechanical linkage 118 causes the presser plate rocker shaft 119 to rotate through an angular displacement of approximately 25° to the position illustrated in FIG. 6B. At that point, the presser plate 82 and needle 84 will be at their lowermost positions providing the smallest gap between the presser plate 82 and the needle plate 78. Thus, the presser plate 82 has moved downward through a stroke of 0.125 inches, thereby causing the presser plate 82 to compact the material 32 to a thickness of approximately 0.125 inches. The needle bar rocker shaft 112 then reverses direction and rotates back through the 40° angular displacement to the position illustrated in FIG. 6A, thereby retracting the needle 84 from the material 32 and rotating the presser plate rocker shaft 119 and lifting the presser plate 82 to their respective original positions. The feed rollers 56, 58 and transverse drive 96 then move the material 32 to an appropriate location for the next stitch as required, for example, by the pattern 64.

Figure 6B:
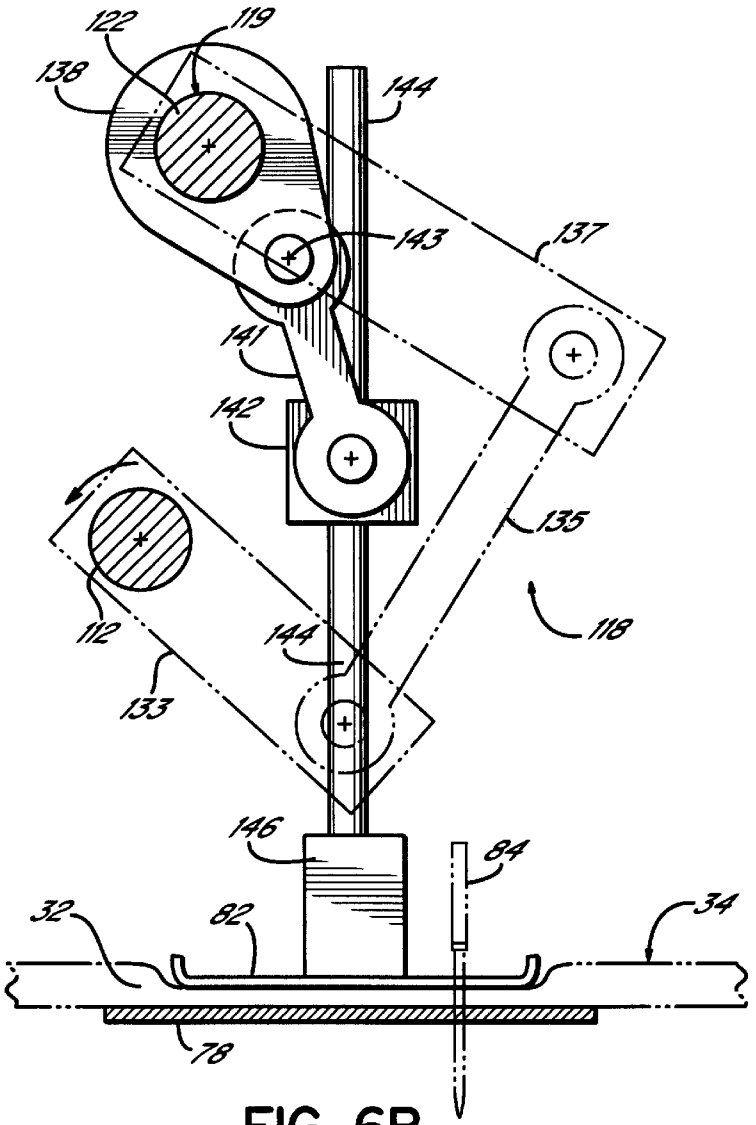
FIGS. 6A and 6B are diagrammatic views illustrating the uppermost and lowermost positions of the presser plate and needle with the presser plate adjusted to stitch fabric having a lesser thickness in accordance with the principles of the present invention.
Figure 6A:
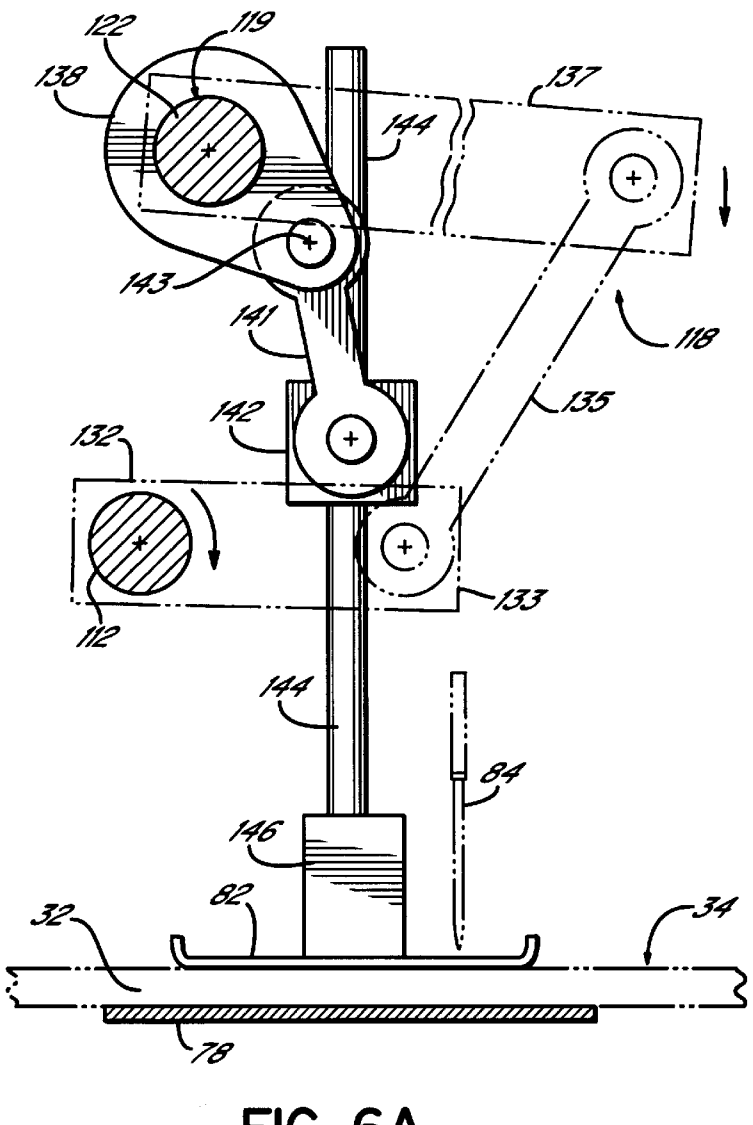

It should be noted that in FIG. 6B, the pivot axes of the presser plate rocker shaft 119, presser plate lever 138 and presser plate drive link 141 form a generally straight line. The toggle formed at the pivot 143 interconnecting the presser plate lever 138 and presser plate drive link 141 functions to provide a dwell time for the presser plate 82 in its lowermost, full compaction position. Preferably, the presser plate rocker shaft 119 rotates several degrees beyond the in-line position to "toggle-over" the pivot 143. The net result is that the presser plate rocker shaft 119 rotates clockwise through a small angle to toggle-over the pivot joint 143, reverses direction and moves in a counterclockwise direction through the same angular displacement without the presser plate 82 experiencing significant vertical motion. Thus, during the time required for the presser plate rocker shaft 22 to move through those angular displacements to toggle-over and retract the pivot 143, the presser plate 82 dwells in a stationary position, thereby maintaining the material 32 in its fully compressed state while the needle 84 is retracting from the material.

Figure 7B:
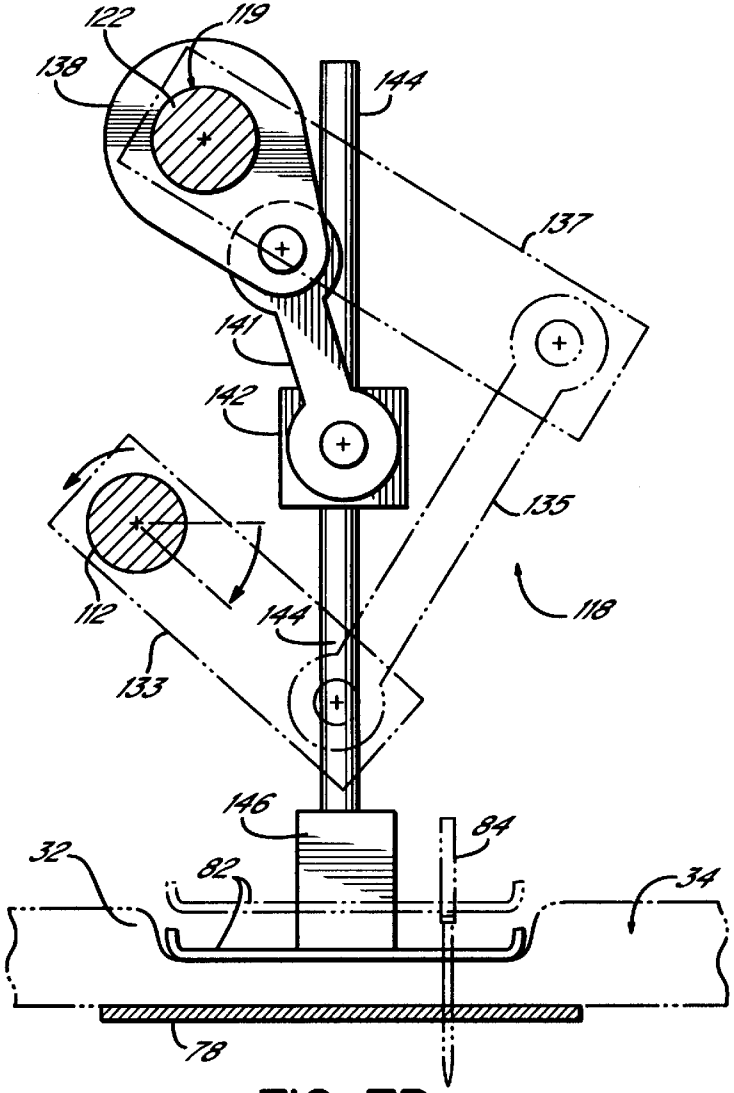
FIGS. 7A and 7B are diagrammatic views illustrating the uppermost and lowermost positions of the presser plate and needle with the presser plate adjusted to stitch fabric having a greater thickness in accordance with the principles of the present invention.
Figure 7A:
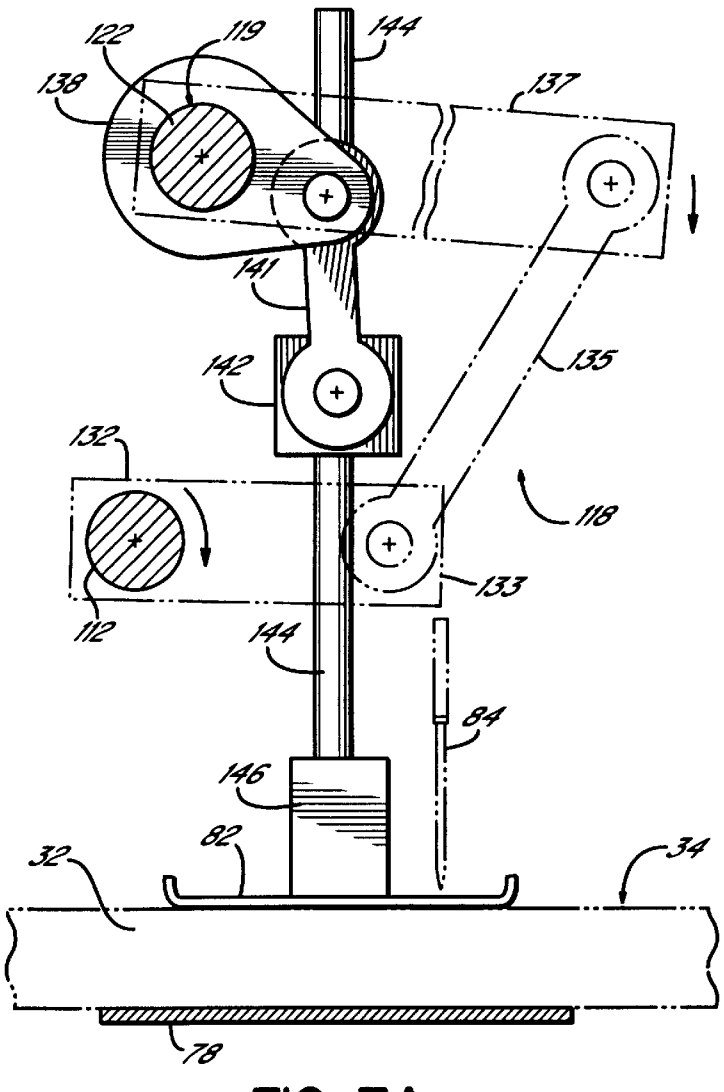

If a thicker quilt is to be stitched, the quilting machine is stopped; and the static phase adjusting coupling 124 is utilized to change the height of the presser plate 82, thereby changing the gap between the presser plate 82 and the needle plate 78. The coupling 124 has an outer ring which is unlocked and then rotated in a direction causing the presser plate rocker shaft 119 to turn counterclockwise as viewed in FIG. 7A. Thus, by rotating the outer ring of the static phase coupling 124, the input presser plate rocker shaft 120 remains stationary, but the output presser plate rocker shaft 122 will rotate, for example, counterclockwise, as viewed in FIG. 7A. Each revolution of the outer ring of the phase coupling 124 results in a rotation of approximately 3.60 of the outer presser plate rocker shaft 122. If it is desired to provide a gap between the presser plate 82 and needle plate 78 of approximately 0.6275 inches as illustrated in FIG. 7A, the output presser plate rocker shaft 122 will have to be moved approximately 24° in the counterclockwise direction. Thus, the outer ring of the phase adjusting coupling 124 must be moved through approximately 6.7 revolutions. When rotation of the outer collar of phase coupling 124 results in the presser plate 82 having the desired gap or distance from the needle plate 78, the outer ring of the phase coupling 124 is then locked into position, and the stitching cycle may be initiated. In this example, using the coupling 124, the gap between the presser plate 82 and the needle plate 78 is easily increased to approximately 0.6275 inches as illustrated in FIG. 7A.

Thereafter, a second fabric 32 having layers of a second thickness are loaded into the quilting machine 20, and the operation of the quilting machine is started. In this example, a stitching cycle is executed corresponding to that shown in FIGS. 7A, 7B which, except for the size of the gap between the presser plate 82 and the needle plate 78, is substantially the same as the cycle illustrated in FIGS. 6A, 6B. That is, from the highest, fully retracted position of the presser plate 82 and needle 84 illustrated in FIG. 7A to the fully extended, lowermost position of the presser plate 82 and needle 84 illustrated in FIG. 7B, the needle bar rocker shaft 112 rotates through approximately 40°. The mechanical linkage 118 with the presser plate rocker shaft 119 causes the presser plate rocker shaft 119 to rotate clockwise through an angular displacement of approximately 25°. That angular displacement of the presser plate rocker shaft 119 causes the presser plate 82 to move downward through a compression stroke of approximately 0.375 inches to provide full compression with a gap of approximately 0.25 inches between the presser plate 82 and needle plate 78. The needle bar rocker shaft 112 then reverses direction and rotates counterclockwise through an angular displacement of approximately 40° to move the linkages of presser plate 82 and needle 84 to the fully retracted positions illustrated in FIG. 7A.

Thus, the present invention provides a quilting machine and method that is substantially more flexible in its operation. The quilting machine of the present invention permits different gaps between the presser plate 82 and the needle plate 78 to be easily set, so that fabric layers of different thicknesses can be stitched on the same machine. The gap between the presser plate 82 and the needle plate 78 is adjusted simply in seconds by changing the setting of the static phase coupling 124, and it is not necessary to exchange cams or other mechanical components which requires many hours of complex and difficult labor to accomplish. The quilting machine of the present invention provides its user with opportunities to supply different quilted products in a way that was not possible in the past with a single quilting machine.

While the invention has been set forth by a description of the preferred embodiment in considerable detail, it is not intended to restrict or in any way limit the claims to such detail. Additional advantages and modifications will readily appear to those who are skilled in the art. For example, as illustrated in FIG. 3, a lever arm 132 is utilized to impart angular oscillations to the needle bar rocker shaft 112. Similarly, a second lever arm 133 is used to transmit an angular oscillation from the needle bar rocker shaft 112 to the presser plate rocker shaft 119. As will be appreciated, the levers 132 and 133 may be integrated into a single unitary lever that extends from either one side or both sides of the needle bar rocker shaft 112.

Further, the disclosed embodiment in FIG. 3 illustrates the motor 106 directly driving the drive shaft 108. As will be appreciated, the motor 106 and drive shaft 108 may be mechanically coupled with other devices, for example, timing belts, chains, etc., in a known manner. Further, the quilting station 30 illustrated in FIGS. 3–5 provides two needle bars 88. As will be appreciated by those skilled in the art, different numbers of needle bars 88 may be utilized by the quilting station. It is further appreciated that the invention described herein by which the static phase coupling 124 is utilized to change the relative angular positions of the input and output presser plate rocker shafts 120, 122 may be used with any type and style of quilting machine. Further, the application of the static phase coupling 124 is independent of the relative degree of automation of the quilting machine.

Therefore, the invention in its broadest aspects is not limited to the specific detail shown and described. Consequently, departures may be made from the details described herein without departing from the spirit and scope of the claims which follow.

What is claimed is:

1. An apparatus for stitching fabric to produce a quilted fabric comprising:

a needle plate for supporting the fabric;

a presser plate located at a first position above the needle plate and supported for linear motion;

a needle located above the presser plate and supported for linear motion;

a needle rocker shaft mounted for rotational motion and rotationally oscillating through angular displacements, the needle rocker shaft being mechanically connected to the needle and imparting a reciprocating motion to the needle in response to the angular displacements of the needle rocker shaft;

a presser plate rocker shaft mounted for rotational motion, the presser plate rocker shaft being mechanically connected to the needle rocker shaft and imparting a reciprocating motion to the presser plate in response to the angular displacements of the needle rocker shaft, the presser plate rocker shaft further having an output shaft being movable from a first to a second relative angular position with respect to an input shaft, thereby locating the presser plate at a second position with respect to the needle plate and permitting quilts of different thicknesses to be stitched.

2. An apparatus for stitching fabric to produce a quilted fabric comprising:

a needle plate for supporting the fabric;

a presser plate located above the needle plate and supported for linear motion;

a needle located above the presser plate and supported for linear motion;

a needle rocker shaft mounted for rotational motion and rotationally oscillating through angular displacements, the needle rocker shaft being mechanically connected to the needle and imparting a reciprocating motion to the needle in response to the angular displacements of the needle rocker shaft;

a presser plate rocker shaft mounted for rotational motion, the presser plate rocker shaft including drive linkage imparting a reciprocating motion to the presser plate, in synchronized relationship to the angular displacements of the needle rocker shaft, toward and away from the needle plate; and an adjustment device linked to the presser plate rocker shaft for changing the range of rotational motion of the presser plate rocker shaft to cause it to reciprocate the presser plate to different locations with respect to the needle plate, thereby permitting quilts of different thicknesses to be stitched.

3. A method of stitching fabric on a quilting machine to produce a quilted fabric, the quilting machine having a needle plate for supporting the fabric, a presser plate located above the needle plate, a needle located above the presser plate, a needle rocker shaft rotationally oscillating through angular displacements, and a presser plate rocker shaft mechanically connected to the needle rocker shaft, the method comprising:

setting the presser plate to a first position above the needle plate;

loading a first fabric of a first thickness into the quilting machine;

oscillating the needle rocker shaft to impart an oscillation to the presser plate rocker shaft and cause a synchronized operation of the needle and the presser plate, thereby stitching the first fabric;

stopping the needle rocker shaft;

setting the presser plate to a second position above the needle plate without exchanging cams on the machine;

loading a second fabric of a second thickness into the quilting machine; and oscillating the needle rocker shaft to impart an oscillation to the presser plate rocker shaft and cause a synchronized operation of the needle and the presser plate, thereby stitching the second fabric.

* * * * *

UNITED STATES PATENT AND TRADEMARK OFFICE

CERTIFICATE OF CORRECTION

PATENT NO. : 6,145,456
DATED : November 14, 2000
INVENTOR(S) : Richard N. Codos

It is certified that error appears in the above-identified patent and that said Letters Patent is hereby corrected as shown below:

Column 4,
Line 64, delete "3600" and insert therefor -- 360° --.

Signed and Sealed this

Twenty-fifth Day of December, 2001

*Attest:*

*Attesting Officer*

JAMES E. ROGAN
*Director of the United States Patent and Trademark Office*